US011730203B2

(12) United States Patent
Han et al.

(10) Patent No.: US 11,730,203 B2
(45) Date of Patent: Aug. 22, 2023

(54) ELECTROMAGNETIC HEATING SMOKING PARAPHERNALIA CAPABLE OF EVENLY HEATING TOBACCO PARTICLES

(71) Applicant: CHINA TOBACCO YUNNAN INDUSTRIAL CO., LTD, Kunming (CN)

(72) Inventors: Jingmei Han, Kunming (CN); Xudong Zheng, Kunming (CN); Jianguo Tang, Kunming (CN); Ru Wang, Kunming (CN); Zhiqiang Li, Kunming (CN); Ping Lei, Kunming (CN); Shanzhai Shang, Kunming (CN); Xu Zeng, Kunming (CN); Chengya Wang, Kunming (CN); Dalin Yuan, Kunming (CN); Zhiyong Sun, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 1085 days.

(21) Appl. No.: 16/459,625

(22) Filed: Jul. 2, 2019

(65) Prior Publication Data

US 2019/0343180 A1 Nov. 14, 2019

(30) Foreign Application Priority Data

May 8, 2018 (CN) ..... 201810432621.5

(51) Int. Cl.
*A24F 47/00* (2020.01)
*A24F 40/465* (2020.01)
*A24F 40/20* (2020.01)

(52) U.S. Cl.
CPC ..... *A24F 40/465* (2020.01); *A24F 40/20* (2020.01)

(58) Field of Classification Search
CPC ..... A24F 40/00; A24F 40/20; A24F 40/30; A24F 40/40; A24F 40/46; A24F 40/465
See application file for complete search history.

(56) References Cited

U.S. PATENT DOCUMENTS

2017/0105452 A1* 4/2017 Mironov ..... A24F 47/008
2018/0317286 A1* 11/2018 Rojo-Calderon

FOREIGN PATENT DOCUMENTS

WO WO 2016/179376 A1 * 10/2016 ..... A24F 47/00

* cited by examiner

*Primary Examiner* — Michael H. Wilson
*Assistant Examiner* — Daniel Edward Vakili
(74) *Attorney, Agent, or Firm* — Bayramoglu Law Offices LLC

(57) ABSTRACT

An electromagnetic heating smoking paraphernalia capable of evenly heating tobacco particles includes a tobacco particle heating tank, wherein the tobacco particle heating tank includes a metal inductive cylinder and a tight coil, a space between the metal inductive cylinder and the tight coil is a tobacco particle holding cavity; an end of the tobacco particle holding cavity is provided with an upper end wall, the upper end wall is provided with an upper end wall vent hole, the other end of the tobacco particle holding cavity is provided with a lower end wall, the lower end wall is provided with a lower end wall vent hole; the tight coil means that adjacent turns of the coil are tightly placed close to each other in a longitudinal axial direction without a gap; an inner wall of the metal inductive cylinder is provided with an inner wall vent hole.

5 Claims, 3 Drawing Sheets

ELECTROMAGNETIC HEATING SMOKING PARAPHERNALIA CAPABLE OF EVENLY HEATING TOBACCO PARTICLES

CROSS REFERENCE TO THE RELATED APPLICATIONS

This application is based upon and claims priority to Chinese Patent Application No. 201810432621.5, filed on May 8, 2018, the entire contents of which are incorporated herein by reference.

TECHNICAL FIELD

The present invention belongs to the field of novel cigarette smoking paraphernalia, and particularly relates to an electromagnetic heating smoking paraphernalia capable of evenly heating tobacco particles.

BACKGROUND

A novel heat-not-burn cigarette product heats tobacco through an external heat source up to a temperature lower than the combustion temperature of a conventional cigarette. In this way, the heat-not-burn cigarette is heated to its volatilization temperature to produce smoke, and massive harmful substances produced by the combustion of the cigarette can be highly reduced, so as to reduce the harm of passive smoking to the non-smokers.

However, among the existing novel heat-not-burn cigarette products, there are two heating methods. One is circumferential heating, namely to heat periphery of the cigarette by a plurality of heating sheets provided circumferentially. The cigarette paper wrapping the tobacco will partially hinder heat conduction. Moreover, the cigarette paper may be burnt to emit a scorched smell, affecting the flavor of cigarettes. The other one is central heating, namely to insert the cigarette in a cigarette holding cavity with a sheet-like heating unit provided at the center, and the heating unit is inserted into the cigarette for heating. In order to extract the cigarette after smoking, the tobacco material also needs to be wrapped by the cigarette paper to make it an integration. Besides, in order to insert the sheet-like heating unit, the tobacco material wrapped by the cigarette paper usually has a rebuilt sheet form presenting a folded paper shape, resulting in an uneven heating, i.e., the tobacco material close to the sheet-like heating unit is overheated while the tobacco material far from the sheet-like heating unit is underheated, thus leading to an uneven emission of smoke.

Besides, no matter which heating method is employed, in order to minimize the tobacco scraps left in the cigarette holding cavity, when extracting the cigarette after smoking, tobacco particles are not recommended to be used as the tobacco material in the cigarette. Instead, smokers prefer to use the above-mentioned rebuilt tobacco sheets presenting the folded paper shape, or integrated tobacco blocks formed by casting or die casting. However, the rebuilt tobacco sheets and the integrated tobacco blocks have a small specific surface area, affecting the emission of tobacco aroma.

It is therefore an objective of the present invention to solve the above issues.

SUMMARY

The present invention provides an electromagnetic heating smoking paraphernalia capable of evenly heating tobacco particles which includes:

a tobacco particle heating tank; wherein the tobacco particle heating tank includes a metal inductive cylinder and a tight coil wrapping the metal inductive cylinder at a certain distance, a space between the metal inductive cylinder and the coil is a tobacco particle holding cavity; an end of the tobacco particle holding cavity is provided with an upper end wall, the upper end wall is provided with an upper end wall vent hole, the other end of the tobacco particle holding cavity is provided with a lower end wall, the lower end wall is provided with a lower end wall vent hole, the tight coil means that the adjacent turns are tightly placed close to each other in a longitudinal axial direction without a gap, and an inner wall of the metal inductive cylinder is provided with an inner wall vent hole.

Preferably, the metal inductive cylinder is formed by rolling up a metal net.

Preferably, the electromagnetic heating smoking paraphernalia capable of evenly heating tobacco particles of the present invention further includes an e-juice atomizer located in an upstream of the tobacco particle heating tank. The e-juice atomizer is interconnected to the tobacco particle holding cavity through the lower end wall vent hole and the inner wall vent hole for air to pass through.

Preferably, the electromagnetic heating smoking paraphernalia capable of evenly heating tobacco particles of the present invention further includes a cigarette filter located in a downstream of the tobacco particle heating tank. The cigarette filter and the tobacco particle heating tank are interconnected to each other through the upper end wall vent hole for the airflow to pass through.

Preferably, the electromagnetic heating smoking paraphernalia capable of evenly heating tobacco particles of the present invention further includes tobacco particles contained in the tobacco particle holding cavity. The tobacco particles include tobacco shreds, tobacco grains, and tobacco scraps.

The working process of the present invention is as follows.

The scattered tobacco particles are filled into the cigarette particle holding cavity, either fully or partially, and preferably, the cigarette particle holding cavity is full. Then, applying a high-frequency alternating electric current to the tight coil to generate a high-frequency alternating magnetic field, inducing an eddy current in the metal inductive cylinder and making the metal inductive cylinder heat the tobacco particles in the cigarette particle holding cavity to release cigarette fragrance, and the cigarette fragrance passes through the upper end wall vent hole to enter the cigarette filter to be inhaled by users.

Under the circumstance where the electromagnetic heating smoking paraphernalia capable of evenly heating tobacco particles of the present invention includes the e-juice atomizer located in an upstream of the tobacco particle heating tank, when applying the electric current to the tight coil, the e-juice atomizer is initiated at the same time, and electronic cigarette smoke is produced by heating the e-juice in the e-juice atomizer; the electronic cigarette smoke flows into the tobacco particle holding cavity through the lower end wall vent hole and the inner wall vent hole to further heat the tobacco particles, and the electronic cigarette smoke is mixed with a smoke produced by heating the tobacco particles, and then flows into the cigarette filter to be inhaled by the users.

The present invention has the following advantages.

1. The cigarette particle holding cavity is enclosed by the tight coil, the metal inductive cylinder, the upper end wall, and the lower end wall, having corresponding vent holes for smoke to flow in and out. The tobacco particles of high specific surface area can be used, breaking through the limitation that only folded tobacco sheets or integrated tobacco blocks can be used. When the specific surface area is higher, the heating area of tobacco is larger, the smoke release volume is higher and the released smoke is more uniform. Moreover, the use of the cigarette papers can be avoided, eliminating bad smell caused by heating the cigarette papers.

2. When the e-juice atomizer is provided in an upstream of the tobacco particle heating tank, the electronic cigarette smoke can be employed as a supplementary to heat the tobacco particles to enable the tobacco particles to emit fragrance, thus obtaining a smoke with a mixed fragrance, avoiding drawbacks such as lack of the electronic cigarette smoke volume and weak fragrance.

3. The tobacco particles can be replaced when used up, thus the tobacco particle heating tank can be repeatedly used.

Figure 1:
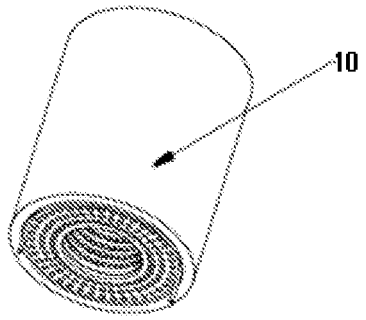
FIG. 1 is a perspective view of a tobacco particle heating tank of the present invention.
Figure 2:
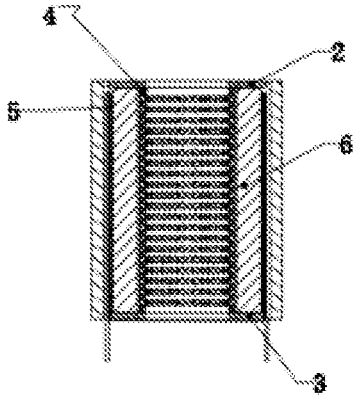
FIG. 2 is a sectional view showing the tobacco particle heating tank according to the present invention.
Figure 3:
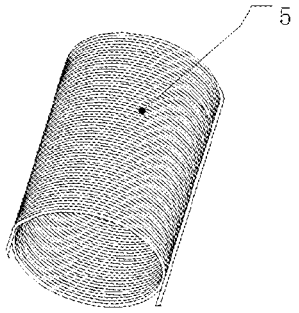
FIG. 3 is a structural schematic diagram showing a tight coil according to the present invention.
Figure 4:
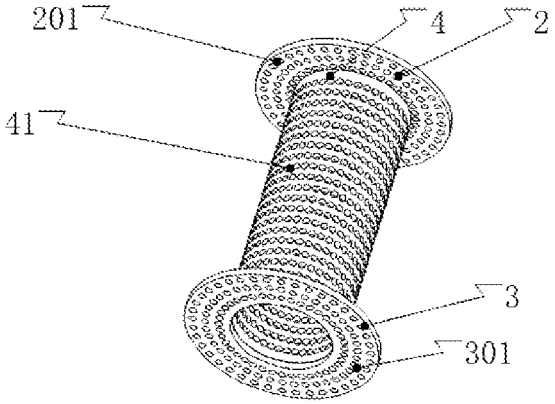
FIG. 4 is a structural schematic diagram showing a metal inductive cylinder, an upper end wall, and a lower end wall in a combined stated according to the present invention.
Figure 5:
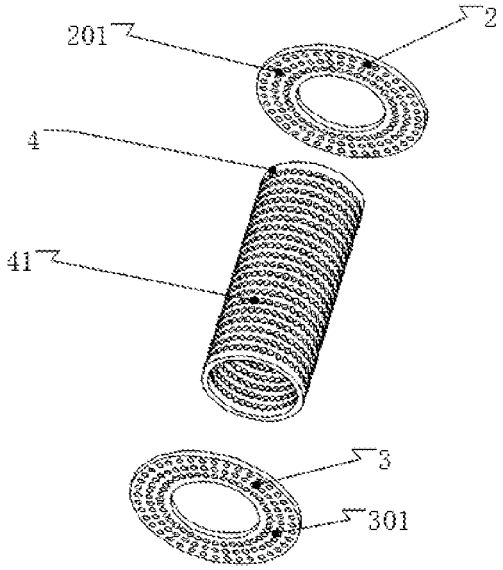
FIG. 5 is a structural schematic diagram of the metal inductive cylinder, the upper end wall and the lower end wall in a separate state according to the present invention.
Figure 6:
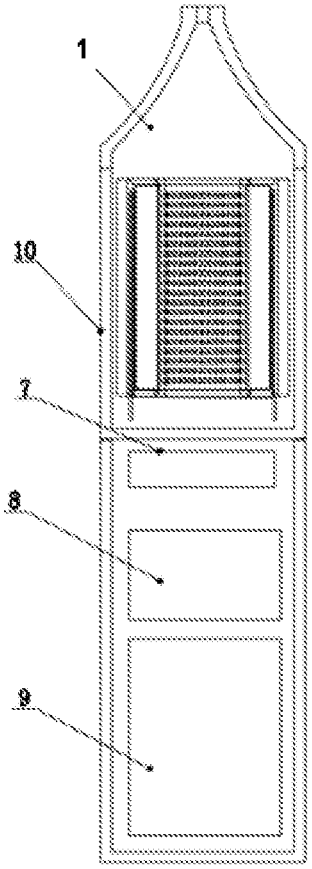
FIG. 6 is a structural schematic diagram showing an electromagnetic heating smoking paraphernalia with an e-juice atomizer according to the present invention.

The reference designators in the drawings are described below:

1: cigarette filter, 2: upper end wall, 201: upper end wall vent hole, 3: lower end wall, 301: lower end wall vent hole, 4: metal inductive cylinder, 5: tight coil, 6: tobacco particle holding cavity, 7: control panel, 8: e-juice atomizer, 9: battery, 10: tobacco particle heating tank.

DETAILED DESCRIPTION OF THE EMBODIMENTS

The present invention will be further described hereinafter with reference to the drawings. The embodiments below are merely intended to explain the technical solutions of the present invention more clearly, rather than limit the scope of the present invention.

A core component of an electromagnetic heating smoking paraphernalia capable of evenly heating tobacco particles of the present invention is the tobacco particle heating tank 10. The tobacco particle heating tank 10 includes the metal inductive cylinder 4 and the tight coil 5 wrapping the metal inductive cylinder 4 at a distance. A space between the metal inductive cylinder and the tight coil is the tobacco particle holding cavity 6. An end of the tobacco particle holding cavity 6 is provided with the upper end wall 2. The upper end wall is provided with the upper end wall vent hole 201. The other end of the tobacco particle holding cavity is provided with the lower end wall 3. The lower end wall is provided with the lower end wall vent hole 301. The tight coil 5 means that adjacent turns of the coil are tightly placed close to each other in a longitudinal axial direction without a gap. An inner wall of the metal inductive cylinder 4 is provided with the inner wall vent hole 41. Preferably, the metal inductive cylinder 4 is formed by rolling up a metal net.

The scattered tobacco particles are filled into the cigarette particle holding cavity 6 in advance, either fully or partially, and preferably, the cigarette particle holding cavity is full. Then a power supply is initiated to apply a high-frequency alternating electric current to the tight coil 5. Consequently, the tight coil produces a high-frequency alternating magnetic field, inducing an eddy current in the metal inductive cylinder and making the metal inductive cylinder heat the cigarette particles in the cigarette particle holding cavity 6 to release cigarette fragrance. The cigarette fragrance passes through the upper end wall vent hole 201 and enters the cigarette filter 1 to be inhaled by users. After being used for many times, the cigarette filter 1 and the upper end wall can be unscrewed to throw away the used tobacco particles and new tobacco particles can be filled for smoking next time.

In one preferred embodiment, the electromagnetic heating smoking paraphernalia capable of evenly heating tobacco particles of the present invention further includes the e-juice atomizer 8 located in an upstream of the tobacco particle heating tank 10. The e-juice atomizer is interconnected to the tobacco particle holding cavity 6 through the lower end wall vent hole 301 and the inner wall vent hole 41 for air to pass through. When applying an electric current to the tight coil, the e-juice atomizer is initiated at the same time to produce electronic cigarette smoke by heating the e-juice in the e-juice atomizer. The electronic cigarette smoke enters the cigarette particle holding cavity 6 through the lower end wall vent hole 301 and the inner wall vent hole 41 to further heat the tobacco particles, and enters the cigarette filter 1 to be inhaled by the users after mixing with the smoke produced by heating the tobacco particles.

What is claimed is:

1. An electromagnetic heating smoking paraphernalia capable of evenly heating tobacco particles, comprising:

a tobacco particle heating tank, wherein the tobacco particle heating tank comprises a metal inductive cylinder and a tight coil wrapping the metal inductive cylinder at a distance, a space between the metal inductive cylinder and the tight coil is a tobacco particle holding cavity; a first end of the tobacco particle holding cavity is provided with an upper end wall, the upper end wall is provided with an upper end wall vent hole, a second end of the tobacco particle holding cavity is provided with a lower end wall, the lower end wall is provided with a lower end wall vent hole; the tight coil means that adjacent turns of a coil are tightly placed close to each other in a longitudinal axial direction without a gap; an inner wall of the metal inductive cylinder is provided with an inner wall vent hole.

2. The electromagnetic heating smoking paraphernalia capable of evenly heating tobacco particles according to claim 1, further comprising an e-juice atomizer located upstream of the tobacco particle heating tank, the e-juice atomizer is interconnected to the tobacco particle holding cavity through the lower end wall vent hole and the inner wall vent hole.

3. The electromagnetic heating smoking paraphernalia capable of evenly heating tobacco particles according to claim 1, wherein a cigarette filter is provided in a downstream of the tobacco particle heating tank, the cigarette filter and the tobacco particle heating tank are interconnected to each other through the upper end wall vent hole for airflow to pass through.

4. The electromagnetic heating smoking paraphernalia capable of evenly heating tobacco particles according to claim 1, further comprising tobacco particles contained in the tobacco particle holding cavity, wherein the tobacco particles comprise tobacco shreds, tobacco grains or tobacco piece scraps.

5. The electromagnetic heating smoking paraphernalia capable of evenly heating tobacco particles according to claim 1, wherein a cigarette paper is not used.

* * * * *